US007921007B2

(12) United States Patent
Van de Par et al.

(10) Patent No.: US 7,921,007 B2
(45) Date of Patent: Apr. 5, 2011

(54) SCALABLE AUDIO CODING

(75) Inventors: Steven Leonardus Josephus Dimphina Elisabeth Van de Par, Eindhoven (NL); Valery Stephanovich Kot, Eindhoven (NL); Nicolle Hanneke Van Schijndel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1083 days.

(21) Appl. No.: 11/573,570

(22) PCT Filed: Jul. 25, 2005

(86) PCT No.: PCT/IB2005/052483

§ 371 (c)(1),
(2), (4) Date: Feb. 12, 2007

(87) PCT Pub. No.: WO2006/018748

PCT Pub. Date: Feb. 23, 2006

(65) Prior Publication Data

US 2007/0198274 A1 Aug. 23, 2007

(30) Foreign Application Priority Data

Aug. 17, 2004 (EP) ..... 04103940

(51) Int. Cl.

| | |
|---|---|
| ***G10L 19/00*** | (2006.01) |
| ***G10L 21/00*** | (2006.01) |
| ***G10L 19/12*** | (2006.01) |
| ***G10L 21/02*** | (2006.01) |
| ***G10L 19/02*** | (2006.01) |

(52) U.S. Cl. ..... 704/200.1; 704/201; 704/220; 704/223; 704/226; 704/227; 704/228; 704/229

(58) Field of Classification Search ..... 704/200.1, 704/201, 220, 223, 226–229

See application file for complete search history.

(56) References Cited

U.S. PATENT DOCUMENTS 4,815,132 A 3/1989 Minami (Continued)

FOREIGN PATENT DOCUMENTS

EP 1006510 A 6/2000

(Continued)

OTHER PUBLICATIONS

Myburg, "Design of a scalable parametric audio coder", Ph.D.thesis, Technische Universiteit Eindhoven, Eindhoven, TheNetherlands, Jan. 2004, pp. 1-156.*

(Continued)

*Primary Examiner* — Eric Yen

(57) ABSTRACT

The invention relates to an audio encoder and decoder and methods for audio encoding and decoding. In a preferred encoder embodiment an audio signal is encoded by deterministic encoder means to form a first encoded signal part. A spectrum of the audio signal is determined and represented by an excitation pattern, i.e. spectral values corresponding to human auditory filters, as a second encoded signal part. A masking curve is also extracted based on the excitation pattern, thus improving encoding efficiency in terms of bit rate. In a preferred decoder the first encoded signal part is decoded by deterministic decoder means. A noise generator uses the decoded first signal part together with the second signal part, i.e. the excitation pattern for the original audio signal, to generate a noise signal. The noise signal is then added to the first decoded signal part to form an output audio signal. At the decoder side the masking curve is also extracted based on the second encoded signal part, i.e. the excitation pattern. The noise signal is generated so that the output audio signal exhibits an excitation pattern nearly identical to the original audio signal. Thus, a perceived high quality audio is obtained while the encoded signal is scalable since a possible deviation between encoding and decoding of the first signal part is compensated by the noise generator at the decoder side. In preferred embodiments the coding means comprises a sinusoidal coder.

18 Claims, 1 Drawing Sheet

U.S. PATENT DOCUMENTS

| | | | | |
|---|---|---|---|---|
| 5,623,577 | A | 4/1997 | Fielder | |
| 5,632,003 | A * | 5/1997 | Davidson et al. | 704/200.1 |
| 5,659,661 | A * | 8/1997 | Ozawa | 704/228 |
| 5,842,160 | A * | 11/1998 | Zinser | 704/229 |
| 5,864,794 | A * | 1/1999 | Tasaki | 704/200.1 |
| 5,909,663 | A * | 6/1999 | Iijima et al. | 704/226 |
| 6,064,954 | A * | 5/2000 | Cohen et al. | 704/207 |
| 6,493,665 | B1 | 12/2002 | Su et al. | |
| 6,615,169 | B1 * | 9/2003 | Ojala et al. | 704/205 |
| 6,952,677 | B1 * | 10/2005 | Absar et al. | 704/500 |
| 7,272,556 | B1 * | 9/2007 | Aguilar et al. | 704/230 |
| 7,447,631 | B2 * | 11/2008 | Truman et al. | 704/230 |
| 7,457,742 | B2 * | 11/2008 | Kovesi et al. | 704/201 |
| 7,458,852 | B2 * | 12/2008 | Gunreben | 439/596 |
| 7,461,003 | B1 * | 12/2008 | Tanrikulu | 704/500 |
| 2003/0182104 | A1 * | 9/2003 | Muesch | 704/200.1 |
| 2003/0187663 | A1 | 10/2003 | Truman et al. | |
| 2004/0002856 | A1 | 1/2004 | Bhaskar et al. | |
| 2004/0165737 | A1 * | 8/2004 | Monro | 381/106 |

FOREIGN PATENT DOCUMENTS

| | | | |
|---|---|---|---|
| WO | 9857436 | | 12/1998 |
| WO | 2004049311 | A1 | 6/2004 |
| WO | 2005001814 | A1 | 1/2005 |

OTHER PUBLICATIONS

Hendriks et al, "Perceptual lin-ear predictive noise modelling for sinusoid-plus-noise audiocoding," in Proc. IEEE Int. Conf. Acoustics, Speech, Signal Pro-cessing (ICASSP '04), vol. 4, Montreal, Quebec,Canada, May 2004, pp. 189-192.*

Eliathamby Ambikairajah, Julien Epps, Lee Lin, "Wideband Speech and Audio coding Using Gammatone Filter Banks", Proceedings of the Acoustics, Speech, and Signal Processing, 200. on IEEE international Conference—vol. 02, 2001.*

L. Lin, E. Ambikairajah, W.H. Holmes, "Wideband Speech and Audio Coding in the Perceptual Domain", International Series in Engineering and Computer Science, 2002.*

Mohamed Meky, Tarek Saadawi, "Prediction of Speech Quality Using Radial Basis Functions Neural Networks", IEEE 1997.*

Jongseo Sohn, Suhong, Ryu, Wonyong Sung, "A Codebook Shaping Method for Perceptual Quality Improvement of CELP Coders", IEEE 2001.*

Myburg P. Francois; "Design of a Scalable Parametric Audio Coder", Phd Thesis. Tech. Univ. Eindhoven, Jan. 6, 2004, XP002360057.

S. Van De Par et al; "A New Psychoacoustical Masking Model for Audio Coding Applications", ICASSP 2002, IEEE Intl Conf. on Acoustics, Speech, and Signal Proc. Proceedings, vol. 4, May 13, 2002, pp. 11-1805, XP010804246.

B. Espinoza-Varas et al; "Evaluating a Model of Auditory Masking for Applications in Audio Coding", Appl. of Signal Processing to Audio and Acoustics, 1995, IEEE ASSP Workshop on New Paltz, NY, Oct. 15, 1995, pp. 195-197, XP010154664.

S. Van De Par et al; "Scalable Noise Coder for Parametric Sound Coding", 118th Convention of the Audio Eng. Society, vol. 118, No. 6465, May 28, 2005, LPP 1-8, XP008056775.

* cited by examiner

SCALABLE AUDIO CODING

FIELD OF THE INVENTION

The invention relates to the field of audio signal coding. Especially, the invention relates to efficient audio coding adapted for low bit rates. More specifically, the invention relates to scalable audio coding. The invention relates to an encoder, a decoder, methods for encoding and decoding, an encoded audio signal, storage and transmission media with data representing such encoded signal, and devices with an encoder and/or decoder.

BACKGROUND OF THE INVENTION

Within low bit rate audio coding often the available bit rate is too low to model an entire spectrum of an audio signal with a deterministic type of encoder, such as a sinusoidal or a waveform encoder. Two approaches have been used to overcome this problem.

According to one approach bandwidth of the signal to be modeled is limited such that the available bit rate is sufficient to model the limited bandwidth with the deterministic encoder. A disadvantage of this approach is that the necessary bandwidth limitation is effectively a reduction in audio quality.

According to a second approach the entire bandwidth is modeled. Part of the signal is modeled with the deterministic encoder using a large portion of the available bit rate and the remaining parts of the audio signal are modeled with noise. This often leads to reasonable results because the perceived bandwidth and timbre of the original audio signal is nearly maintained. However, regarding the second mentioned approach a problem is to determine how the noise signal should be generated.

When a sinusoidal encoder is used as a deterministic encoder, often a residual signal, i.e. a signal that is left after subtracting the sinusoidal components in each audio segment, is used as a basis for estimating noise parameters. Many advanced encoders prepare the residual signal before noise parameter estimation to overcome some artefacts such as an overly noisy sound quality of the decoded signal or low frequency artefacts due to poor spectral resolution of the noise encoder. An example on such approach is seen in WO 2004049311.

When a waveform encoder is used, e.g. a transform encoder, the encoder decides which audio bands should not or can not be modeled by the transform encoder. Information about these omitted bands is then transmitted so as to allow the decoder to generate noise accordingly.

The above described methods suffer from the disadvantage that already at the encoder side final decisions have to be made about the noise signal that is going to be generated at the decoder side. As a consequence, it is not permitted that parameters or data for the deterministic part of the decoder are changed once the signal has been encoded. This may happen for example during transmission of the encoded signal or during fast rescaling of a compressed audio file where certain layers of information are dropped. If this is done, the consequence will be that, at the decoder side, the generated noise signal will not match the resulting signal from the deterministic decoder part and considerable audible artefacts can be the result. In other words, noise coding according to the described principles is not scalable because it does not allow modifications to the deterministic signal after noise parameters have been estimated.

SUMMARY OF THE INVENTION

It may be seen as an object of the present invention to provide a method and an audio encoder and decoder providing a scalable encoding, i.e. allowing modifications of the encoded signal prior to decoding, without considerable audible artefacts of the resulting decoded signal.

According to a first aspect of the invention, this object is complied with by providing an audio encoder adapted to encode an audio signal, the audio encoder comprising:

encoder means adapted to encode the audio signal into a first encoded signal part, computation means adapted to compute a representation of an excitation pattern of the audio signal and provide it as a second encoded signal part, the computation means further being adapted to compute a representation of a masking curve based on the representation of the excitation pattern, and provide the representation of the masking curve to the encoder means so as to optimize encoding efficiency.

By the term 'excitation pattern' is understood spectral energy distribution across auditory filters in the human auditory system, see also [1] (referring to the list of references at the end of the section "Description of preferred embodiments"). An excitation pattern is a representation of the human basilar membrane or human auditory nerve response to an audio signal. This response can be modeled by a filter bank of e.g. 40 parallel auditory filters. Thus, a representation of the excitation pattern comprising 40 values each of which relate to a signal level of a frequency band of an auditory filter, is considered an appropriate model of the human auditory system. Thus, the excitation pattern of an audio signal is a parametric spectral description of the audio signal. By a representation of e.g. 40 values, that are correlated due to the spectral overlap of the auditory filter shapes, the inclusion of the excitation pattern is quite inexpensive in terms of amount of data to be included in the encoded audio signal if for example differential encoding is used. Depending on e.g. target frequency range, the excitation pattern may be represented by fewer than 40 values, such as 30 values, such as 20 values, or even fewer.

By 'masking curve' related to an audio signal is understood a spectral representation of the human hearing threshold given the audio signal as input to the human auditory system. With respect to encoding precision this is important since it provides the encoder means with information that possible distortion or noise products added to the original signal are not perceivable as long as these products do not exceed the masking curve. Thus, encoding of e.g. sinusoidal amplitudes or transform coefficients can be performed avoiding unnecessary bit allocation for details of the original signal that can not be perceived e.g. by encoding signal components relative to the masking curve. Hereby, the masking curve representation helps to improve encoding efficiency of the encoder means.

The audio encoder according to the first aspect provides a scalable encoded signal due to the inclusion of the second encoded signal part, i.e. the inclusion of the excitation pattern of the original audio signal in an output bit stream of the encoder. Thus, since a decoder receiving the encoded signal is provided with information regarding the excitation pattern of the original signal, it is possible to add an appropriate signal, for instance noise, to a first decoded signal part so as to generate a resulting signal exhibiting an excitation pattern nearly identical to that of the original signal. As a result the perceived timbre of the reproduced signal will resemble the original signal, and thus a crucial parameter relating to overall sound quality is ensured.

Perceptually, recreating the original excitation pattern is an appropriate perceptual target because the excitation pattern describes an energy distribution across different auditory filters and as such comprises no more and no less spectral envelope information than necessary for reconstruction of he original spectrum envelope appropriately. It should be noted, though, that the excitation pattern does not include all perceptually relevant information. Temporal structure of an audio signal is generally not captured within the excitation pattern. As far as this temporal information is perceptually relevant it is assumed that in part this is modeled with the encoder means, and as such included in the first encoded signal part. However, the excitation pattern encoder can also encode temporal information in two ways. First, by regular update of the excitation parameters. Second, by using a temporal envelope including required temporal information to modulate the signal to be added to the first decoded signal part.

Another advantage of including the excitation pattern of the original audio signal in the encoded bit stream is that it provides convenient information for easy computation of a representation of a corresponding masking curve of the original signal—both at the encoder and the decoder side. Knowledge of the masking curve is important with respect to coding efficiency of the first encoded signal part since the masking curve comprises information that enables the encoder to decide whether certain parts of parameter values can be omitted since they will not be perceived by a listener in the final signal due to masking by the human auditory system. Preferably, the representation of the masking curve is computed based on a quantized representation of the excitation pattern at the encoder side. Hereby, it is ensured that identically the same masking curve is available at the encoder and the decoder side.

Preferably the audio encoder means comprises a deterministic signal type of encoder selected from the group consisting of: parametric encoders (e.g. a sinusoidal encoder), transform encoders, waveform encoders, Regular Pulse Excitation encoders, and Codebook Excited Linear Predictive encoders.

A second aspect of the invention provides an audio decoder adapted to regenerate an audio signal from an encoded audio signal, the audio decoder comprising:

means adapted to generate, from a second encoded audio signal part, a representation of an excitation pattern of the audio signal, decoder means adapted to generate a first decoded signal part from a first encoded signal part, signal generator means adapted to generate a second decoded signal part, so that a sum of the first and second decoded signal parts exhibits an excitation pattern being substantially equal to the excitation pattern of the audio signal.

For the purpose of creating a decoded audio signal with perceivably spectral properties similar to the original signal, the excitation pattern of the original signal is compared to an excitation pattern of a decoded first encoded signal part. A possible deviation will be compensated by the decoder by adding an appropriate signal so that at least the resulting signal will be similar to the original audio signal with respect to excitation pattern. Thus, the decoder does not need to comprise decoding means being exactly inverse to the encoder means.

Preferably, the decoder comprises means for providing a sum of the first and second decoded signal parts as a representation of the original audio signal.

Preferably, the decoder means comprises a deterministic signal type of decoder selected from the group consisting of: parametric decoders (e.g. a sinusoidal encoder), transform decoders, waveform decoder, Regular Pulse Excitation encoders, and Codebook Excited Linear Predictive encoders.

The decoder means may utilize a representation of the masking curve based on the original audio signal that was used in the encoder. This masking curve is conveniently based on the representation of the excitation pattern extracted from the second decoded signal part.

The signal generator means may comprise a noise generator or spectral band replication means or a combination thereof. Preferably, the signal generator comprises means to generate the second decoded signal part based on the representation of the excitation pattern by using an iterative method.

In a third aspect the invention provides a method of encoding an audio signal, comprising the steps of:

computing a representation of an excitation pattern of the audio signal, computing a representation of a masking curve based on the representation of the excitation pattern, encoding the audio signal according to an encoding scheme into a first encoded signal part by utilizing the masking curve, and providing a second encoded signal part comprising the representation of the excitation pattern of the audio signal.

The same explanation applies as for the first aspect.

In a fourth aspect the invention provides a method of regenerating an audio signal from an encoded audio signal, the method comprising the steps of:

generating from a second encoded signal part, a representation of an excitation pattern of the audio signal, generating from the representation of the excitation pattern, a representation of a masking curve, decoding a first encoded signal part, according to a decoding scheme, into a first decoded signal part, generating a second decoded signal part, based on the representation of the excitation pattern, so that a sum of the first and second decoded signal parts exhibits an excitation pattern substantially equal to the excitation pattern of the audio signal.

The same explanation applies as for the second aspect.

In a fifth aspect the invention provides an encoded audio signal representing an original audio signal, the encoded signal comprising a first part comprising a first encoded signal part, and a second part comprising a representation of an excitation pattern of the audio signal.

The encoded signal may be a digital electrical signal with a format according to standard digital audio formats. The signal may be transmitted using an electrical connecting cable between two audio devices. However, the encoded signal could be a wireless signal, such as an air-borne signal using a radio frequency carrier, or it may be an optical signal adapted for transmission using an optical fiber.

In a sixth aspect the invention provides a storage medium comprising data representing an encoded audio signal according to the fifth aspect. The storage medium is a non-transitory computer-readable storage medium such as DVD, DVD+r, DVD+rw, DVD-r, DVD-rw, CD, CD-r, CD-rw, read-writable CD, compact flash, memory stick. However, it may also be a computer data storage medium such as a computer hard disk, a computer memory, a solid-state device, a floppy disk etc. In one embodiment, computer-readable program code is adapted to encode an audio signal according to the encoding method disclosed herein. In other words, the later embodiment includes a non-transitory computer-readable storage medium embodied with computer program code for being loaded into a memory and executed by a signal processor for encoding an audio signal according to the encoding method disclosed herein. In another embodiment, a computer-readable program code is adapted to decode an encoded audio signal according to the decoding method disclosed herein. In other words, the later embodiment includes a non-transitory computer-readable storage medium embodied with computer program code for being loaded into a memory and executed by a signal processor for decoding an encoded audio signal according to the decoding method disclosed herein.

In a seventh aspect the invention provides a device comprising an audio encoder according to the first aspect.

In an eighth aspect the invention provides a device comprising an audio decoder according to the second aspect.

Preferred devices according to the seventh and eighth aspects are all different types of tape, disk, or memory based audio recorders and players. For example: Portable audio devices, car CD players, DVD players, audio processors for computers etc. In addition, it may be advantageous for mobile phones.

BRIEF DESCRIPTION OF THE DRAWINGS

In the following the invention is described in more details with reference to the accompanying figures of which.

Figure 1:
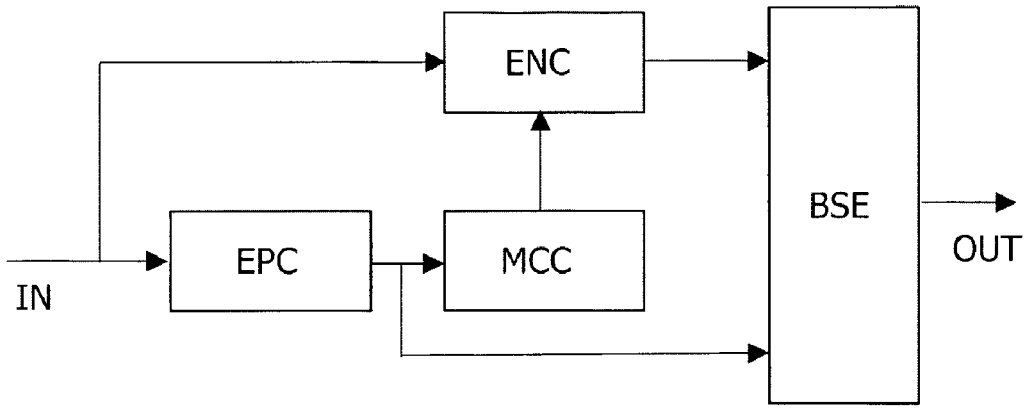
FIG. 1 illustrates a block diagram of a preferred audio encoder.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF PREFERRED EMBODIMENTS

FIG. 1 shows a block diagram illustrating the principles of a preferred audio encoder with respect to signal flow. An audio input signal IN is applied to encoder means ENC. The encoder means ENC provides a first encoded signal part that is applied to a bit stream encoder BSE that provides the first encoded signal part to an output bit stream OUT from the audio encoder. Preferably, the encoder means comprises a deterministic type of encoder, such as a sinusoidal encoder or a transform encoder. In case of a sinusoidal encoder, the encoder determines which parts of the audio input signal IN to be modeled with sinusoids. In case of a transform encoder, the encoder means determines a set of transform coefficients to represent the audio input signal IN.

In the embodiment of FIG. 1 a spectral representation of the audio input signal IN is represented by its excitation pattern. The audio input signal IN is applied to excitation pattern computation means EPC adapted to compute an excitation pattern of the original signal, preferably 40 values are used to represent the excitation pattern, e.g. the levels of critical bands of the human auditory system. However, for certain applications it may be preferred to exclude some of the auditory filters, so that e.g. only 30 values from the complete excitation pattern are used. For applications where the lowest audio frequency range is not important, such as mobile phones, some of the lowest frequency band may be ignored.

Preferably, the excitation pattern is calculated for short segments of the input signal in such a way that changes over time in the excitation pattern can be tracked. The excitation pattern is applied to the bit stream encoder BSE and is thus included in the output bit stream OUT.

The audio encoder comprises a masking curve computation unit MCC adapted to receive the excitation pattern computed by the excitation pattern computation means EPC. A masking curve computed by the masking curve computation unit MCC based on the excitation pattern is applied to the encoder means ENC. The encoder means ENC is adapted to improve its encoding efficiency based on the masking curve since the masking curve informs the encoder means about parts of the audio input signal IN that need not be encoded since they will be masked by the human auditory system and thus are not perceivable in the final signal. Additionally, encoding of the parameters of the first encoded signal part can be performed e.g. relative to the masking curve, thus avoiding unnecessary bit allocation. Preferably the masking curve is computed in accordance with [2]. Further details regarding masking curve computation are given below.

Figure 2:
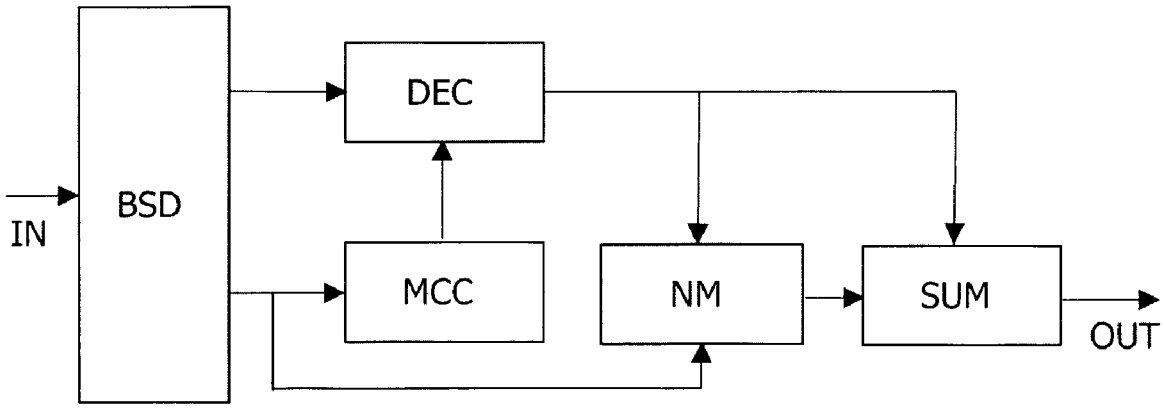
FIG. 2 illustrates a block diagram of a corresponding audio decoder.

FIG. 2 illustrates a preferred audio decoder, preferably for use to receive an input bit stream IN representing an encoded audio signal from the audio encoder described above. The audio decoder comprises a bit stream decoder BSD adapted to retrieve information from the input bit stream IN such that first and second encoded signal parts are generated.

The first encoded signal part is applied to decoder means DEC that preferably comprises a deterministic type of decoder, such as a sinusoidal or a transform decoder. The decoder means DEC is necessarily of the same type as the encoder that produced the first encoded signal part. However, it may be the case that in the decoder a downscaled version of the bit stream/parameters is received than originally transmitted or available at the encoder. The decoder means DEC generates a first decoded signal part in response to the first encoded signal part.

The second encoded signal part, i.e. the excitation pattern of the original audio signal, is applied to a signal generator, in this preferred embodiment illustrated as a noise modeler NM. The first decoded signal part is also applied to the noise modeler NM that generates a second decoded signal part in response. The noise modeler NM is adapted to generate the second decoded signal part, i.e. a noise signal, so that a sum of the first and second decoded signal parts forms a representation of the original audio signal and exhibits an excitation pattern deviating only insignificantly from the excitation pattern of the original audio signal. Further details in this regards are given below.

The first and second decoded signal parts are applied to summation means SUM adapted to add the first and second decoded signal parts so as to generate an output signal OUT being a decoded representation of the encoded audio signal received in the input bit stream IN and thus being a representation of the original audio signal.

The audio decoder further comprises a masking curve computation unit MCC adapted to receive the second encoded signal part, i.e. the original signal excitation pattern. In response the masking curve computation unit MCC applies to the decoder means DEC a masking curve representation based on the original excitation pattern. This masking curve representation is used by the decoder DEC to decode the first encoded signal part, if encoding of the parameters of the first encoded signal part was performed e.g. using the masking curve, thus avoiding unnecessary bit allocation.

In the following an audio encoder embodiment scheme as shown in FIG. 1 is assumed, with the encoding means ENC being a sinusoidal encoder. The sinusoidal encoder is assumed to be based on sinusoidal analysis technique as described in [3].

A first step by encoding the audio input signal IN is to estimate the excitation pattern. This estimation is preferably based on a perceptual model described in [2]. In [2] it is found that a masking function $\nu(f_m)$ is given by:

$$\frac{1}{\nu^2(f_m)} = C_s\hat{L}\sum_i \frac{|H_{om}(f_m)|^2|\gamma_i(f_m)|^2}{\sum_f |H_{om}(f)|^2|\gamma_i(f)|^2|m(f)|^2 + C_a} \quad (1)$$

where $f_m$ is a frequency for which a masking curve is calculated, $f$ is a frequency of a component in a masker spectrum, $\hat{L}$ is an effective duration of an audio segment under evaluation, $H_{om}$ is an assumed filtering in the human outer and middle ear, $\gamma_i$ is a transfer function of the i-th gamma tone filter modeling the human auditory filter function, m is a spectrum of the original audio input signal, while $C_a$ and $C_s$ are calibration constants.

The excitation pattern is defined by the following quantity:

$$E_i = \sum_f |H_{om}(f)|^2|\gamma_i(f)|^2|m(f)|^2. \quad (2)$$

This excitation pattern has an index i specifying an auditory filter number. In general, the number of auditory filters can be limited to about 40 values, and therefore a relatively inexpensive representation is obtained of the spectrum of the original input audio signal. Each of the excitation parameters, $E_i$, needs to be quantized before encoding is possible. A logarithmic quantization is preferred. Preferably, a step size between 0.5 dB and 5 dB is used, more preferably the step size is about 2 dB. Resulting quantized parameters are denoted $E_{qi}$.

Once the excitation pattern is known, the masking curve is also known, as can be seen from Eq. (1), where the denominator comprises an expression equal to the i-th excitation pattern parameter and the numerator does not depend on the input signal. Thus, Eq. (1) can be rewritten to:

$$\frac{1}{\nu^2(f_m)} = C_s\hat{L}\sum_i \frac{|H_{om}(f_m)|^2|\gamma_i(f_m)|^2}{E_{qi} + C_a}. \quad (3)$$

Preferably the quantized excitation parameters are used for generating the masking curve. This ensures that the masking curve used by the encoder will be identical to the one used by the decoder, since the masking curve computed at the decoder side necessarily is based on the quantized excitation parameters received in the second encoded signal part.

The encoding of the excitation pattern parameters $E_{qi}$ by the bit stream encoder BSE can be done efficiently by using intra-frame differential encoding. By defining $E_{\Delta qi}=E_{q(i+1)}-E_{qi}$ a suitable set of differential parameters can be obtained that do not vary much and in this case additional time-differential encoding may be used for some of the frames.

In the encoder embodiment with a sinusoidal encoder, part of the input audio signal IN is modeled with sinusoids. The sinusoidal parameters can be encoded more effectively by use of the masking curve. There are several ways to benefit from the information contained in the masking curve. One method is to divide all sinusoidal amplitude values by the masking curve. By performing this transformation, entropy of the amplitude parameters will decrease because the distribution of amplitude values is compacted considerably by the masking curve division.

An alternative method of gaining benefit from it is to utilize the masking curve in a high rate quantization scheme such as proposed in [4]. Note that alternatively, when a transform encoder is used for encoding a deterministic signal part, some techniques (see e.g. [5]) weight the transform coefficients by the masking function before encoding the transform coefficients. At the decoder side an inverse transformation is performed. The weighting curve effectively removes the need for encoding side information specifying scaling of transform coefficients.

The decoding process starts with decoding the excitation pattern parameters. Using Eq. (3) the masking curve can be derived which is made available to the decoder means DEC in its decoding of the first encoded signal part.

The noise modeler NM generates a noise signal in response to the excitation pattern and the first decoded signal part. Various algorithms exist that can be used for synthesizing a noise signal such that this noise signal together with the first decoded signal part has an excitation pattern similar to the original audio signal. In the following one method will be described that yields good results with a relatively low computational complexity.

Assuming that the length of the analysis and the synthesis segment is M, where M is an even number, then in the spectral representation of synthesis segment the first ½M complex numbers define the complete signal because it is known that the time-domain signal is real. The ½M numbers are partitioned in L noise bands with a bandwidth proportional to Equivalent Rectangular Bandwidth (ERB) such as proposed in [6]. The L start positions of each noise band are denoted $k_j$. In addition, $k_{j+1}$ is the end position plus one of the last noise band.

A spreading matrix G is defined as:

$$G_{ij} = \sum_{f=k_j}^{k_{j+1}-1} \gamma_i^2(f)H_{om}^2(f). \quad (4)$$

The spreading matrix defines how the energy within each noise band j is distributed across auditory filters i. Based on the spreading matrix a backward spreading matrix is defined as:

$$H_{ji} = \frac{G_{ij}}{\sum_{i=1}^{N} G_{ij}}. \quad (5)$$

The algorithm will now try to find energy values $X_j$ for each noise band such that $$b_iE_{di} + \sum_{j=1}^{L} G_{ij}X_j \quad (6)$$

is as close as possible to the excitation pattern $E_{qi}$ of the original signal for each i. Note that $E_{di}$ is the excitation pattern of the first encoded signal part, and $b_i$, $b_i \geqq 1$, is a factor adapted to compensate for the effects of quantization in the first and second encoded signal parts which could lead to an excess of noise that is generated by the decoder. A good value for $b_i$ has been found to be 1.3, however, a dependence on the chosen quantization scheme and on i, with larger values for small i's (i.e. low frequencies) may lead to improved results. For $b_i$=1 no compensation is made.

The following 6 steps define a preferred iterative method of finding a suitable solution for $X_j$:

Step 1, for all j, initialize $X_j$:

$$X_j=1. \tag{7}$$

Step 2, calculate excitation pattern according to:

$$\hat{E}_{qi} = b_i E_{di} + \sum_{j=1}^{N} G_{ij} X_j. \tag{8}$$

Step 3, calculate error according to:

$$\varepsilon_i = \frac{E_{qi}}{\hat{E}_{qi}}. \tag{9}$$

Step 4, propagate error according to:

$$c_j = \sum_{i=1}^{N} H_{ji} \varepsilon_i. \tag{10}$$

Step 5, correct error according to:

$$X_j := X_j c_j. \tag{11}$$

Step 6, if the iteration process has not finished, go back to step 2.

Preferably a stop criterion for this iterative method is chosen so that the iteration stops after all $c_j$ values are close enough to unity or alternatively after a fixed number of iterations. It the latter is chosen as stop criterion a total of 20 iterations has been found to be enough to yield a good quality noise signal.

The energy values $X_j$ are now applied to the spectral representation of a noise signal W such that for each energy band j:

$$\sum_{f=k_j}^{k_{j+1}-1} W^2(f) = X_j. \tag{12}$$

An inverse discrete Fourier Transform is used to convert this signal to the time domain. This is followed by a scaling, windowing, and overlap-add to allow for the final construction of the noise signal that is ready to be added to the first decoded signal part.

The above described embodiment using a sinusoidal encoder to generate the first encoded signal part has been tested at a sampling frequency of 44.1 kHz using a segment length M=2048 and a 50% overlap between segments. When only intra-frame differential encoding of the excitation pattern parameters is used, a bit rate of 9-10 kbps is required to represent the excitation pattern, i.e. the second encoded signal part.

In combination with the sinusoidal encoder/decoder a good audio quality can be obtained where generally the noise is integrated well with the deterministic signal part from the sinusoidal decoder. The noise model has been proven to be scalable. Independent of the number of sinusoids that were used in the sinusoidal decoder the same excitation pattern could be transmitted and a suitable noise signal could be generated at the decoder side to complement the sinusoidal signal part.

Encoders and decoders according to the invention may be implemented on a single chip with a digital signal processor. The chip may then be built into devices such as audio devices. The encoders and decoders may alternatively be implemented purely by algorithms running on a main signal processor of the application device. For example, the encoder and decoder embodiments can each include a computer-readable medium embodied with computer program code for being loaded into a memory and executed by a signal processor for encoding of an audio signal and for decoding an encoded audio signal, respectively, according to the encoding and decoding methods disclosed herein.

In addition to coding efficiency in terms of bit rate, the described coding methods provide a high efficiency also with respect to computational load to be carried out by the encoder.

LIST OF REFERENCES

[1] B. C. J. Moore. *An Introduction to the Psychology of Hearing*. Academic Press, London, 1995.

[2] S. van de Par, A. Kohlrausch, G. Charestan, R. Heusdens (2002). A new psychoacoustical masking model for audio coding applications. In *IEEE Int. Conf. Acoust., Speech and Signal Process.*, Orlando, USA, 2002, pp. 1805-1808.

[3] R. Heusdens, R. Vafin, and W. B. Kleijn. Sinusoidal modeling using psychoacoustic-adaptive matching pursuits. *IEEE Signal Processing Letters,* 9(8): pp. 262-265, August 2002.

[4] R. Vafin and W. B. Kleijn. Entropy-constrained polar quantisation: Theory and an application to audio coding. In *IEEE Int. Conf. Acoust., Speech and Signal Process.*, Orlando, Fla., USA, 2002.

[5] B. Edler and G. Schuller. Audio coding using a psychoacoustic pre- and post-filter. In *IEEE Int. Conf. Acoust., Speech and Signal Process., Vol.* 2, pp. 881-884, 2000.

[6] B. R. Glasberg and B. C. J. Moore. Derivation of auditory filter shapes from notched-noise data. *Hearing Research,* 47: pp. 103-138, 1990.

The invention claimed is:

1. An audio encoder for encoding an audio signal (IN), the audio encoder comprising:

encoder means (ENC) for encoding the audio signal (IN) into a first encoded signal part; and computation means for computing a representation of an excitation pattern of the audio signal and providing the representation of the excitation pattern as a second encoded signal part, wherein the representation of the excitation pattern comprises a representation of human auditory nerve response modeled by a filter bank of parallel auditory filters, the filters in the filter bank having values which relate to a signal level of a frequency band of a corresponding auditory filter, the excitation pattern of the audio signal thereby being a parametric spectral description of the audio signal, the computation means further for computing a representation of a masking curve based on quantized excitation parameters of the representation of the excitation pattern, and providing the representation of the masking curve to the encoder means so as to optimize encoding efficiency of the encoder means, wherein the encoder means encodes signal components of the audio signal relative to the masking curve, further wherein the second encoded signal part, included within an output bit stream of the audio encoder, along with the first signal part, provides a scalable encoded audio signal of the audio encoder.

2. The audio encoder according to claim 1, wherein the audio encoder means comprises a deterministic signal type of encoder selected from the group consisting of: parametric encoders, transform encoders, waveform encoders, Regular Pulse Excitation encoders, and Codebook Excited Linear Predictive encoders.

3. The audio encoder according to claim 1, further comprising:

means for generating a quantized version of the representation of the excitation pattern prior to providing it the representation of the excitation pattern as the second encoded signal part.

4. The audio encoder according to claim 1, further comprising:

means adapted to code the second encoded signal part according to a coding scheme selected from the group consisting of: intra-frame differential coding and across segment differential coding.

5. An audio decoder for regenerating an audio signal from an encoded audio signal based on an original audio signal, the encoded audio signal including a first encoded audio signal part and a second encoded audio signal part, the audio decoder comprising:

means for generating, from the second encoded audio signal part, a representation of an excitation pattern of the original audio signal, wherein the representation of the excitation pattern comprises a representation of human auditory nerve response modeled by a filter bank of parallel auditory filters, the filters in the filter bank having values which relate to a signal level of a frequency band of a corresponding auditory filter, the excitation pattern of the audio signal thereby being a parametric spectral description of the original audio signal;

decoder means for generating a first decoded signal part from (i) the first encoded signal part and (ii) a masking curve based on quantized excitation parameters of the representation of the excitation pattern; and signal generator means for generating a second decoded signal part, based on a scalable noise model, in response to the representation of the excitation pattern and the first decoded signal part, so that a sum of the first and second decoded signal parts exhibits an excitation pattern that is substantially equal to the excitation pattern of the original audio signal, for creating a resulting regenerated audio signal with perceivable spectral properties similar to the original audio signal.

6. The audio decoder according to claim 5, further comprising:

summing means for generating a representation of the audio signal as a sum of the first and second decoded signal parts.

7. The audio decoder according to claim 5, wherein the signal generator means comprises means for generating the second decoded signal part based on the representation of the excitation pattern of the original audio signal by using an iterative method.

8. The audio decoder according to claim 5, wherein the signal generator means performs a subtraction of a representation of an excitation pattern of the first decoded signal part from the excitation pattern of the original audio signal.

9. The audio decoder according to claim 5, wherein the signal generator means comprises a noise generator.

10. The audio decoder according to claim 5, wherein the signal generator means comprises spectral band replication means.

11. The audio decoder according to claim 5, wherein the decoder means comprises a deterministic signal type of decoder selected from the group consisting of: parametric decoders, transform decoders, waveform decoder, Regular Pulse Excitation encoders, and Codebook Excited Linear Predictive encoders.

12. The audio decoder according to claim 5, further comprising means for computing a representation of the masking curve corresponding to the representation of the excitation pattern of the original audio signal and providing the representation of the masking curve to the decoder means.

13. A method of encoding an audio signal comprising the steps of:

computing, in an excitation pattern computation means, a representation of an excitation pattern of the audio signal, wherein the representation of the excitation pattern comprises a representation of human auditory nerve response modeled by a filter bank of parallel auditory filters, having values each of which relate to a signal level of a frequency band of a corresponding auditory filter, providing a parametric spectral description of the audio signal;

computing, in a masking curve computation unit, a representation of a masking curve based on quantized excitation parameters of the representation of the excitation pattern;

encoding, using encoding means, the audio signal according to an encoding scheme into a first encoded signal part by utilizing the masking curve so as to optimize an encoding efficiency of the encoding, wherein the encoding encodes signal components of the audio signal relative to the masking curve; and providing, using the excitation pattern computation means, a second encoded signal part comprising the representation of the excitation pattern of the audio signal, wherein the second encoded signal part, for being included within an output bit stream, along with the first signal part, provides a scalable encoded audio signal.

14. A method of regenerating an audio signal from an encoded audio signal based on an original audio signal, the encoded audio signal including a first encoded signal part and a second encoded signal part, the method comprising the steps of:

generating, using a noise modeler, from the second encoded signal part, a representation of an excitation pattern of the original audio signal, wherein the representation of the excitation pattern comprises a representation of human auditory nerve response modeled by a filter bank of parallel auditory filters, having values each of which relate to a signal level of a frequency band of a corresponding auditory filter, providing a parametric spectral description of the original audio signal;

generating, using a masking curve computation unit, from the representation of the excitation pattern, a representation of a masking curve, the masking curve based on quantized excitation parameters of the representation of the excitation pattern;

decoding, using decoding means, a first encoded signal part, according to a decoding scheme, into a first decoded signal part, wherein the decoding includes using the masking curve to decode the first encoded signal part; and generating, using the noise modeler, a second decoded signal part, based on a scalable noise model, in response to the representation of the excitation pattern and the first decoded signal part, so that a sum of the first and second decoded signal parts exhibits an excitation pattern that is substantially equal to the excitation pattern of the original audio signal, for creating a resulting regenerated audio signal with perceivable spectral properties similar to the original audio signal.

15. Device comprising an audio encoder according to claim 1.

16. Device comprising an audio decoder according to claim 5.

17. A non-transitory computer-readable storage medium embodied with computer program code for being loaded into a memory and executed by a signal processor for encoding an audio signal according to the method of claim 13.

18. A non-transitory computer-readable storage medium embodied with computer program code for being loaded into a memory and executed by a signal processor for decoding by regenerating an audio signal from an encoded audio signal according to the method of claim 14.

* * * * *